United States Patent [19]

Zanker

[11] 4,405,005

[45] Sep. 20, 1983

[54] FIREWOOD SPLITTER

[76] Inventor: Dieter S. Zanker, 602 Esquimalt Rd., Victoria, British Columbia, Canada, V9A 3L4

[21] Appl. No.: 260,736

[22] Filed: May 5, 1981

[51] Int. Cl.[3] ..... B27L 7/00

[52] U.S. Cl. ..... 144/193 C; 144/193 D; 173/90; 173/128

[58] Field of Search ..... 173/126, 128, 90, 91; 144/193 R, 193 C, 193 D

[56] References Cited

U.S. PATENT DOCUMENTS

| | | | |
|---|---|---|---|
| D. 257,575 | 12/1980 | Ideen | 254/104 X |
| 1,032,481 | 7/1912 | Hunter, Sr. | 144/193 B |
| 3,856,092 | 12/1974 | Mann | 173/126 |
| 4,254,808 | 3/1981 | Nokes | 144/193 C |
| 4,280,540 | 7/1981 | Meacham | 144/193 C |
| 4,308,903 | 1/1982 | Alloway | 144/193 D |
| 4,327,787 | 5/1982 | Loratto | 144/193 D |

*Primary Examiner*—W. D. Bray

*Attorney, Agent, or Firm*—Carver & Co.

[57] ABSTRACT

A firewood splitter comprises an elongate bar and a wedge-shape splitting tip connected to the bottom end of the bar. A slide hammer has an elongate sleeve slidably received over the bar between the top end and the splitting tip. The sleeve has a top end and a solid core near the top end for impacting the top end of the elongate bar. When the splitting tip is placed on the end grain of a length of firewood, the slide hammer can be slidably raised with respect to the bar so the core is above the top of the bar. The slide hammer is then dropped so the core impacts top end of the bar and the firewood is split by the tip.

10 Claims, 3 Drawing Figures

FIREWOOD SPLITTER

BACKGROUND OF THE INVENTION

This invention relates to a device of the slide hammer type for splitting firewood.

Impact tools utilizing slide hammers have been known for some time as seen in U.S. Pat. No. 2,475,041 to Mattson which shows a wood chisel including a hollow stem and a weighted handle mounted on the stem. This tool is not adapted for splitting of firewood as shown by the screw cap used during an upward impact. The screw cap would eventually break in heavy duty work such as firewood splitting.

U.S. Pat. No. 3,050,095 to Prather shows a somewhat similar device. Again, the tool is relatively small and is not adapted for firewood splitting.

German Pat. No. 822,366 shows a chisel with a sliding hammer and a similar arrangement is shown in Italian Pat. No. 413,580. Other devices of the general type are shown in U.S. Pat. No. 881,538 to Bienk, U.S. Pat. 3,982,572 to Kortendick, U.S. Pat. No. 4,211,264 to Cross and U.S. Pat. No. 4,194,544 to Scott.

Many of these earlier devices are either ill-adapted for splitting firewood or incorporate structural deficiencies which would eventually result in failure of the device. For example, the constant impacting of the slide hammer on the downward stroke as the wood is split, or on the upward stroke to remove the splitting tip from the wood, may cause distortion in parts of the slide hammer. Such distortion can eventually cause the slide hammer to jam and prevent proper operation of the device. The use of threadedly connected or hollow impact parts could reduce the lifespan of a firewood splitting device.

SUMMARY OF THE INVENTION

According to the invention, an apparatus for splitting firewood comprises an elongate bar with a top end and a bottom end. A wedge-shape splitting tip is connected to the bottom end of the bar. A slide hammer has an elongate sleeve slidably received over the bar between the top end and the splitting tip. The sleeve has a top end and a solid core near the top end for impacting the top end of the elongate bar. When the splitting tip is placed on the end grain of a length of firewood, the slide hammer can be slidably raised with respect to the bar so the core is above the top of the bar and then dropped so the core impacts the top end of the bar and the firewood is split by the tip.

Where the bar, the splitting tip and the slide hammer are of metal, the top end of the bar is preferably of a harder metal than the core. When the top end of the bar impacts a bottom end of the core, the bottom end of the core is spread with repeated use, bulging the sleeve and locking the core within the sleeve. The bar remains undistorted for free sliding of the sleeve over the bar.

The apparatus may further comprise an elongate flexible member, such as a chain or a cable, connecting the slide hammer and the splitting tip. The member is sufficiently long to permit the core to be raised above the top of the bar, preventing the removal of the slide hammer from the bar and allowing upward jolting of the slide hammer to remove the splitting tip from the firewood.

Unlike many prior art devices, a firewood splitter according to the invention is capable of splitting firewood efficiently over a lifespan of many years. The splitting force is achieved by downward impacting of the core on the top of the bar, both very rugged components capable of withstanding the forces involved. Repeated impacting causes the bottom end of the core to spread and the sleeve to bulge outwardly adjacent the bottom end of the bar. This does not interfere with free sliding of the sleeve over the bar. Moreover, although the core can be connected to the sleeve by very strong means, such as plug welding, the spreading of the core and the bulging of the sleeve interlocks the two components and prevents failure even if the plug welds should break. The use of a chain or cable connecting the slide hammer to the splitting tip allows upward jolting to remove the tip from the firewood without causing distortion of the slide hammer or the bar such that these components would eventually jam.

DESCRIPTION OF THE PREFERRED EMBODIMENT

Figure 1:
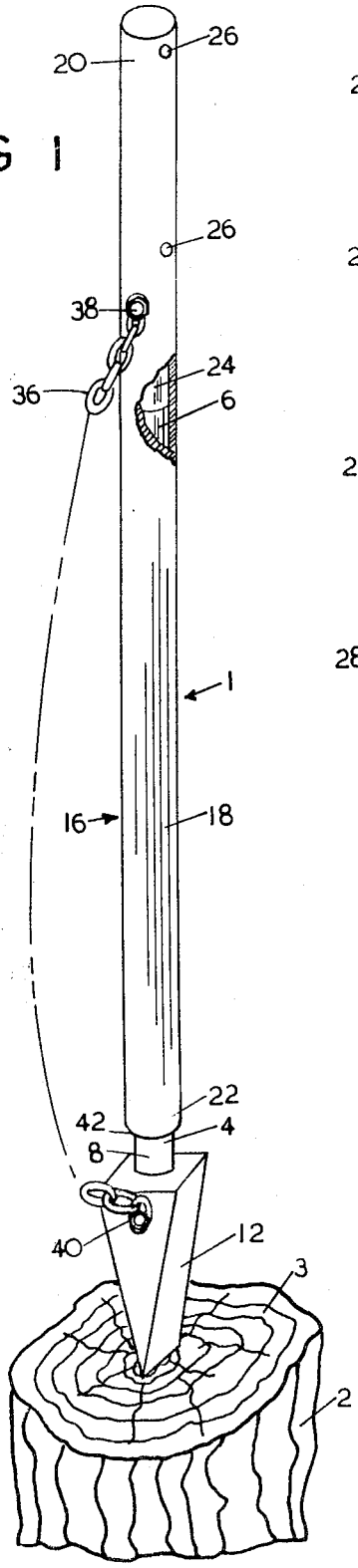
FIG. 1 is a perspective view of an apparatus for splitting firewood according to an embodiment of the invention shown positioned on top of a piece of firewood, with a portion of the sleeve broken away and a part of the connecting chain represented by a chain line.
Figure 2:
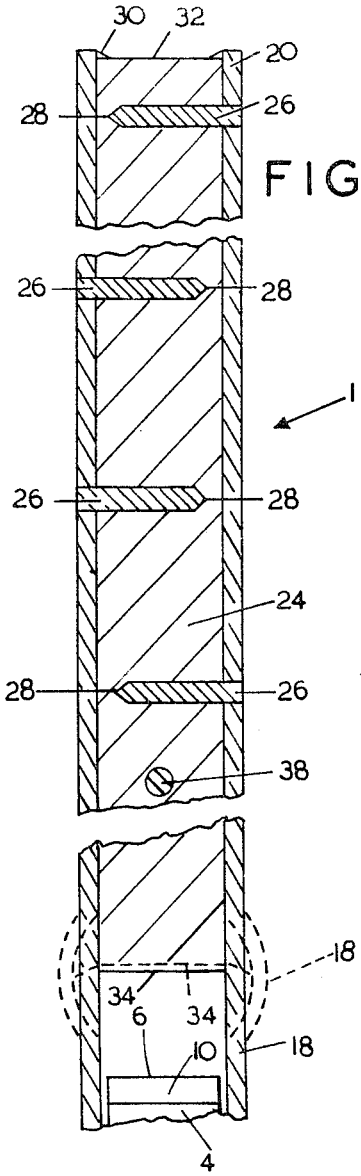
FIG. 2 is an enlarged fragmentary view showing the top portion of the apparatus of FIG. 1 in longitudinal section.

Referring to the drawings, and firstly to FIG. 1, an apparatus 1 is shown which is adapted for splitting firewood such as the length of firewood 2. The apparatus includes an elongate bar 4 having a top end 6 and a bottom end 8. In the preferred embodiment, bar 4 is of steel and is cylindrical in shape. Referring to FIG. 2, a high chromium weld 10 provides a section of hard metal at the top end 6 of the bar. A weld approximately ¼" thick has been found to be sufficient to resist impact forces as described below.

Figure 3:
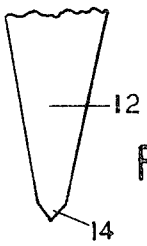
FIG. 3 is a fragmentary elevational view showing the bottom part of the splitting tip.

A wedge-shape splitting tip 12 is connected to the bottom end 8 of the bar 4 by welding in the case of apparatus 1. As seen in FIG. 1, the cutting tip is square in section. The splitting tip has a double-bevelled cutting edge 14 as best illustrated in FIG. 3. The double bevel improves the durability of the cutting tip during use. Edge 14 is preferably non-tempered so that it can be sharpened easily by the user with a hand file.

A slide hammer 16 having an elongate sleeve 18 is received over the bar 4 between the top end 6 and the splitting tip 12. The sleeve 18 comprises a thick-walled pipe which is cylindrical in shape, having a top end 20 and a bottom end 22. A length of approximately 2.5' has been found to provide convenient operation of the apparatus and sufficient weight for the splitting operation.

The slide hammer 16 also includes a solid core 24 for the sleeve 18 near the top end 20 thereof. Core 24 comprises a cylindrical metal bar of sufficient size to be closely received within the sleeve 18. The core is connected to the sleeve by four plug welds 26 filling drill holes 28 extending through the sleeve and into the core 24 as seen best in FIG. 2. In addition, a fillet weld 30 joins the top end 32 of the core with the top end 20 of the sleeve. The core has a bottom end 34 for impacting the top end 6 of bar 4. FIG. 2 illustrates the bottom end of the core partly raised above the top end of the bar, while FIG. 1 illustrates the core against the bar as occurs during impact.

Apparatus 1 includes an elongate, flexible member, in this case chain 36, which connects the slide hammer 16 to the splitting tip 12. Only the top and bottom portions of chain 36 are illustrated in FIG. 1, the rest of the chain being represented by a chain line for simplicity of drawing. The top end of chain 36 is connected to the slide hammer by a bolt 38 which extends through the sleeve and the core. The bottom end of the chain is connected to splitting tip 12 by bolt 40 which extends through the splitting tip. The chain must be sufficiently long and slack to permit the core 24 of slide hammer 16 to be raised well above the top 6 of bar 4. A height of approximately 1' is sufficient. At the same time, the length of the chain must be such to prevent the removal of slide hammer 16 from bar 4. The slack in the chain must therefore be less than the distance between the top 6 of bar 4 and bottom 42 of sleeve 18 in the position of the apparatus shown in FIG. 1. Chain 36 serves not only to prevent removal of the slide hammer from the bar, but allows upward jolting of the slide hammer to remove the splitting tip should it become jammed in the firewood.

In use, the apparatus is positioned as shown in FIG. 1 with the edge of the splitting tip 12 against end grain 3 of log 2. Sleeve 18 of slide hammer 16 may be conveniently grasped by one hand between bolt 38 and the top end 20 thereof. The slide hammer is then raised to take up some or all of the slack in the chain 36 depending upon the strength of the blow desired. The slide hammer is then dropped together with the user's arm, the weight of the slide hammer providing sufficient impact on most occassions. Some downwards force can be added by the user's arm if required. The splitting tip 12 is driven into the log when the bottom 34 of the core impacts the top end 6 of bar 4. These steps are repeated a few times until the wedge-shape splitting tip splits the firewood. It should be noted that the entire operation can be carried out using a single hand. The other hand may be used to take up any slack in the chain to keep the chain away from the splitting tip and the log. As may be seen in FIG. 1, the bottom 42 of sleeve 18 is spaced-apart from splitting tip 12 when the core contacts the top of the bar to prevent fingers from being jammed between the sleeve and the tip.

Although plug welds 26 offer a very strong connection between the core and the sleeve, it is possible that the welds might eventually break over many years of use considering the number of impacts that would take place. However, unlike some prior art devices, apparatus 1 is not weakened, nor is bar 4 subject to jamming within sleeve 18 because of such repeated impacts. Referring to FIG. 2, distortion or spreading of the top end 6 of bar 4, commonly known as "mushrooming", is prevented by the high chromium weld 10 which is of a harder metal than the core 24. Accordingly, the bottom end 34 of the core rather than the top end of the bar is spread with repeated use. Such spreading of the bottom end 34 of the bar is shown greatly exaggerated in broken lines. This spreading of the bottom end of the core causes outward bulging of the sleeve 18 again shown greatly exaggerated in broken lines. It may be seen that the resultant spreading of the core and bulging of the sleeve does not interfere with free sliding of the sleeve over the bar 4. Moreover, this actually results in locking the core within the sleeve. If the plug welds 26 and fillet weld 30 eventually fail, the spread bottom end 34 of the core is interlocked with the bulge in sleeve 18 and keeps the core in position within the sleeve permanently.

The invention offers other advantages over the prior art. For example, as observed in FIG. 1, the width or cross-sectional extent of the splitting tip is greater than the diameter of sleeve 18. Consequently, jamming of the sleeve within the firewood is prevented as the splitting wood moves downwardly through the firewood. The split opened up by complete penetration of the tip is always wider than the sleeve.

Alterations can be made to the embodiment described above within the scope of the invention. For example, chain 36 could be replaced by a rope or a cable. However, a relatively rugged welded link chain is preferred for its durability and long life.

What is claimed is:

1. An apparatus for splitting material such as firewood, comprising:

an elongate metal bar with a top end and a bottom end;

a wedge-shape splitting tip connected to the bottom end of the bar;

a metal slide hammer having an elongate sleeve slidably received over the bar between the top end and the splitting tip, the sleeve having a top end, and a separate solid core having a bottom end for impacting the top end of the elongate bar, the core being fixedly connected to the sleeve by connecting means spaced apart from the bottom end, the core being of a softer metal than the top end of the bar.

2. An apparatus as claimed in claim 1, wherein the connecting means comprises a plurality of plug welds filling drill holes extending through the sleeve and into the core.

3. An apparatus as claimed in claim 2, wherein the sleeve comprises a thick walled pipe.

4. An apparatus as claimed in claim 3, wherein the sleeve and the core are cylindrical in shape.

5. An apparatus as claimed in claim 1, wherein the sleeve has a bottom end spaced-apart from the splitting tip when the core contacts the top of the bar to prevent fingers from being jammed between the sleeve and the tip.

6. An apparatus as claimed in claim 1, wherein the splitting tip has a cross-sectional extent greater than the sleeve to prevent jamming of the sleeve as the tip moves through the material.

7. An apparatus as claimed in claim 1, wherein the splitting tip has a double-bevelled edge.

8. An apparatus as claimed in claim 1, wherein the top end of the bar comprises a high chromium weld.

9. An apparatus for splitting material such as firewood, comprising:

an elongate bar with a top end and a bottom end;

a wedge-shaped splitting tip connected to the bottom end of the bar;

a slide hammer having an elongate sleeve slidably received over the bar between the top end and the splitting tip, the sleeve having a top end and a solid core near the top end for impacting the top end of the elongate bar; and an elongate, flexible member connecting the slide hammer and the splitting tip, said member being sufficiently long to permit the core to be raised above the top of the bar while preventing the removal of the slide hammer from the bar and allowing upward jolting of the slide hammer to remove the splitting tip from the firewood.

10. An apparatus as claimed in claim 9, wherein the flexible member comprises a chain.

* * * * *